United States Patent [19]

Mulder et al.

[11] Patent Number: 4,988,149

[45] Date of Patent: Jan. 29, 1991

[54] REMOVABLE CABINET TOP FOR FRONT-SERVICEABLE APPLIANCE

[75] Inventors: James R. Mulder, Berrien Township, Berrien County; Carl E. Eichman, Lincoln Township, Berrien County, both of Mich.

[73] Assignee: Whirlpool Corporation, Benton Harbor, Mich.

[21] Appl. No.: 423,841

[22] Filed: Oct. 19, 1989

[51] Int. Cl.[5] ..... A47B 77/08

[52] U.S. Cl. ..... 312/223; 312/228

[58] Field of Search ..... 312/223, 228; 361/390, 361/391, 359, 346, 351; 200/61.62; 68/3 R

[56] References Cited

U.S. PATENT DOCUMENTS

| | | | |
|---|---|---|---|
| 3,621,165 | 11/1971 | Stone | 200/61.62 |
| 3,680,152 | 8/1972 | Farrell | 312/228 X |
| 4,215,386 | 7/1980 | Prager et al. | 361/390 X |
| 4,254,640 | 3/1981 | Sherer et al. | 68/3 R |
| 4,268,098 | 5/1981 | Kretchman et al. | 312/210 |
| 4,449,383 | 5/1984 | Cartier | 68/12 R |
| 4,507,942 | 4/1985 | Hirose et al. | 68/20 |
| 4,572,596 | 2/1986 | Weir et al. | 312/257 R |
| 4,618,193 | 10/1986 | Cuthbert et al. | 312/264 |
| 4,754,622 | 7/1988 | Fanson | 68/207 |
| 4,821,535 | 4/1989 | Wassilak et al. | 68/3 R |

*Primary Examiner*—Joseph Falk

*Attorney, Agent, or Firm*—Hill, Van Santen, Steadman & Simpson

[57] ABSTRACT

A front-serviceable appliance of the type requiring removal of a cabinet top for servicing. The invention permits the use of a horizontally sliding cabinet top. The appliance includes resilient retaining clips that secure the cabinet top and simultaneously prevent accidental disconnection of a cabinet-top actuated electrical connection. Also included in a mounting for a water-inlet vacuum-break that allows the vacuum-break to pivot downwardly to provide clearance for sliding of the cabinet top for removal or replacement. The sliding cabinet top reduces vertical space required to gain service access, while the electrical connection eliminates the need for a separate fastener, thus greatly simplifying cabinet top actuation.

23 Claims, 3 Drawing Sheets

REMOVABLE CABINET TOP FOR FRONT-SERVICEABLE APPLIANCE

BACKGROUND OF THE INVENTION

This invention relates to front-serviceable appliances of the type requiring removal of a cabinet top for servicing.

In the field of appliances in general, and domestic laundry appliances in particular, the desirability of conserving floor space while optimizing the proximity of load openings in a washer-dryer combination is well known. Towards this end, the vertical stacking of washers and dryers has been employed with the usual arrangement placing the dryer on top. Although relatively space-efficient, such vertical stacking requires that damp, heavy laundry be lifted from the washer and raised to the height of the dryer load opening. Additionally, the mounts used to achieve vertical stacking interfere with servicing, since they prevent or make awkward the removal or displacement of service panels, such as cabinet tops. Furthermore, previously-known mounts makes it difficult to gain access to electrical connections for panel-mounted components, (e.g. power interrupting lid-open switches).

A coupling device for vertical stacking of laundry appliances is shown in U.S. Pat. No. 4,821,535 to Wassilak, et al the disclosure of which is incorporated herein by reference. The coupling device of this patent permits the removal of a cabinet top, but no details of such removal are disclosed. In most front-serviceable appliances, service panels or housings are hinged to the cabinet and secured into position by retaining clips (see, e.g. U.S. Pat. Nos. 4,618,193 to Cuthbert, et al, 4,572,596 to Weir, et al, or 4,268,098 to Kretchman, et al). Pivoting of the panels or housings provides a clearance for internal components such as water-inlet vacuum-breaks, but requires vertical space over and above the height of the washer, thus significantly increasing the liftover height in a vertically stacked arrangement. The retaining clips of these arrangements are regularly attached to a rear panel of the appliance, which may also contribute to increased liftover height.

SUMMARY OF THE INVENTION

The present invention relates to a front-serviceable appliance of the type requiring the removal of a cabinet top for servicing. The cabinet top slides horizontally for removal or replacement, thus reducing the need for vertical space above the washer and allowing the dryer, and thus liftover height, to be reduced. In order to provide clearance for the cabinet top to slide, this invention mounts the water-inlet vacuum-break on a cabinet-top actuated mounting assembly, so that it pivots below the bottom of the sliding cabinet top. The connection for the power-interrupting top-open switch is also top-actuated. The connection is automatically made when the top is installed and automatically broken when the top is removed, thus eliminating the need for a separate operation to connect or disconnect the switch. Additionally, resilient retaining clips are provided which pivot out of the way to permit the cabinet top to slide. The retaining clips are attached to the top back rail of the cabinet, thus further reducing the above-mentioned vertical space. Another advantage of the present invention lies in the fact that the retaining clips, in conjunction with the top-actuated connection for the power-interrupting lid-open switch, meet Underwriters Laboratories (UL) standards requiring a fastener to prevent accidental disconnection of power-interrupting lid-open switches This eliminates the need for a separate clip and also saves a step in the process of removing the cabinet top.

It is therefore a primary object of this invention to provide a front-serviceable appliance of the type requiring removal of a cabinet top for servicing wherein the vertical space required to provide service access to the interior of appliance is substantially reduced, and the procedure for removal is greatly simplified.

It is another object of this invention to provide a front-serviceable appliance including a cosinusoidal retaining clip that is mounted to the top back rail of the appliance cabinet, is pivotable to permit the cabinet top to slide, and is made up of at least seven opposed curved portions It is a further object of this invention to provide a front serviceable appliance having a spring-lever mounted water-inlet vacuum break that pivots between an operating position and a service position It is yet another object of this invention to provide a front-serviceable appliance having a cabinet top and cabinet top actuated electrical connector that are secured by the same retaining clips.

In attainment of the foregoing objects, this invention contemplates a front-serviceable appliance of the type requiring the removal of a cabinet top for servicing. The appliance includes a resilient retaining clip for securing the cabinet top and at the same time preventing accidental disconnection of a cabinet-top actuated electrical connection. Also provided is a mounting assembly to move the water-inlet vacuum-break from an operating position to a service position. When the cabinet top slides into position, it moves the water-inlet vacuum break into an operating position and permits the retaining clip to secure the cabinet top.

Other objects and advantages of the present invention will be apparent upon reference to the accompanying description when taken in conjunction with the following drawings.

SUMMARY OF THE INVENTION

Figure 1:
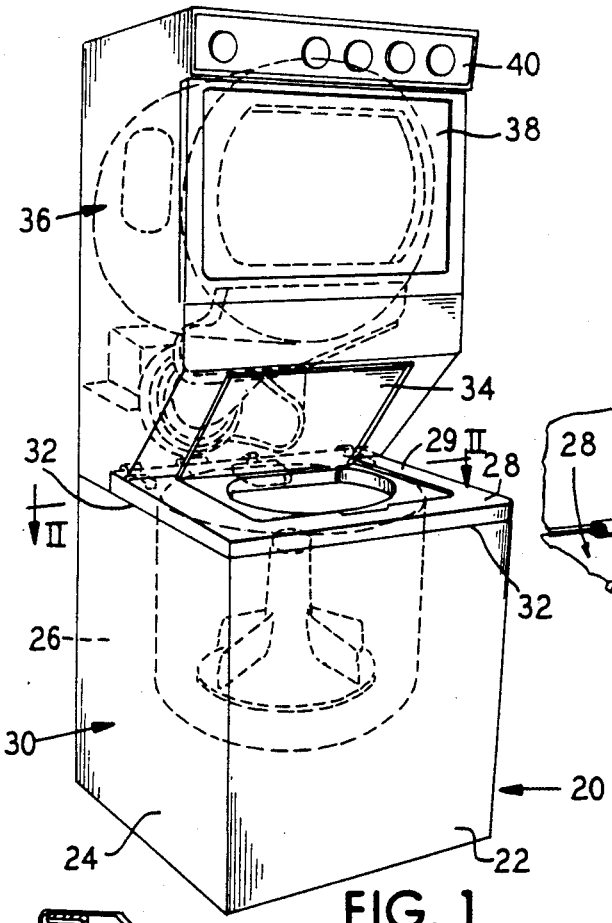
FIG. 1 is an overall perspective view of a vertically stacked washer and dryer embodying the present invention.
Figure 3:
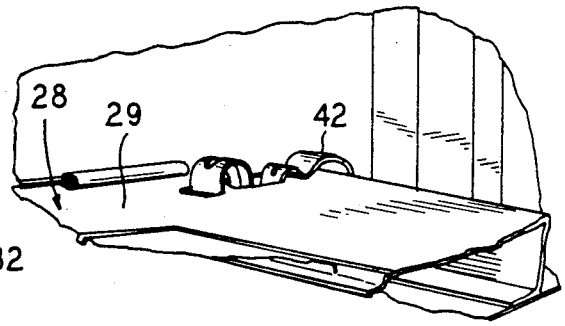
FIG. 3 is a partial perspective view of the retaining clip of the present invention mounted on the washer frame.

A vertically stacked washer and dryer embodying the present invention is shown in FIG. 1. A washer 20 includes a front panel 22, two side panels 24, a rear panel 26, and a top that together form a cabinet 30. The panels have respective top surfaces 32 that are substantially coplanar with one another, and with a top back rail 33 (shown in FIG. 7) of the cabinet. The cabinet top 28 has an upper surface 29 and provides a base for a hinged cabinet lid 34. The washer 20 underlies a dryer 36 having a dryer door 38. Controls 40 for both the washer and dryer are located at the top of the dryer 36.

Figure 2:
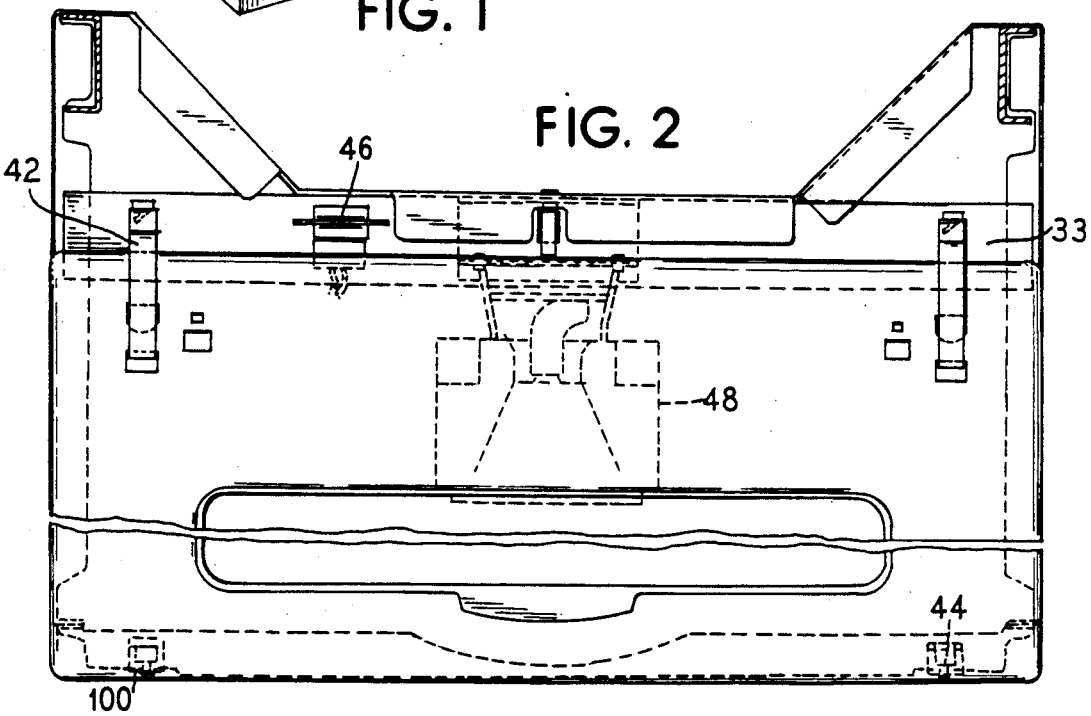
FIG. 2 is a plan view, partially broken away, taken along lines II—II in FIG. 1 and showing a washer cabinet top.

FIG. 2 shows the relative locations of some of the elements that, in combination, form the basis of this embodiment of the present invention. The cabinet top 28 is shown secured with retaining clips 42 and top locks 44. The electrical connector 46 and the water-inlet vacuum break 48 are in their operating positions. These elements are to be described in detail hereinafter.

Figure 7:
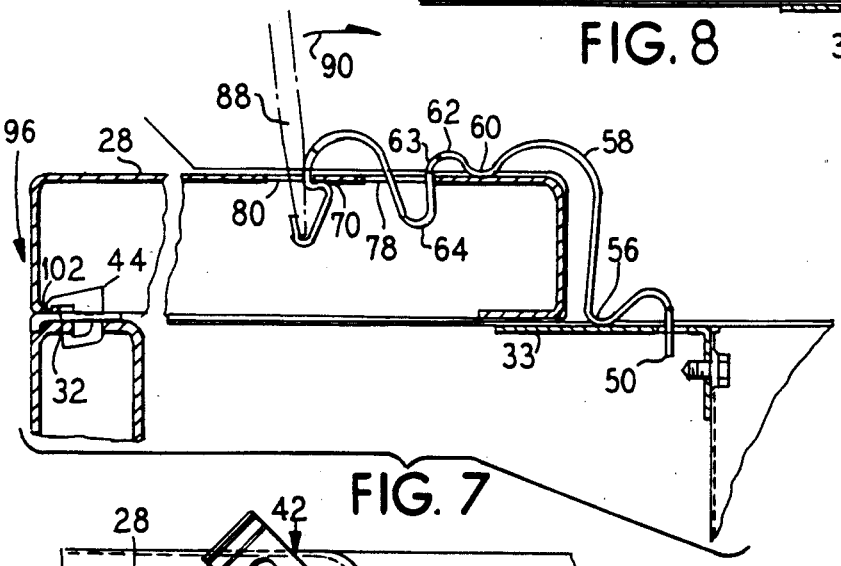
FIG. 7 is a sectional view of the retaining clip showing a suggested method of disengagement from the washer cabinet top.

FIGS. 3–8 illustrate in detail the construction and operation of retaining clip 42. A first end portion 41 of a retaining clip 42 includes a tab 50 separated from the body of the clip by a pair of opposed notches 52. The clip 42 has a first curved portion 54 connecting the first end of the clip to a second curved portion 56, which abuts the top back rail 33 of the cabinet when the top is secured. A third curved portion 58 extends over the upper surface 29 of cabinet top 28, and is connected to a fourth curved portion 60 that abuts the upper surface 29 of the cabinet top 28 when secured. A fifth curved portion 62 connects the fourth curved portion 60 to a sixth curved portion 64. A seventh curved portion 66 extends from the sixth curved portion 64, and joins a second end portion 68 of the retaining clip 42. The second end portion 68 includes a short horizontal portion 70 connected to a straight section 72, which in turn joins a flanged end 74. As shown in FIG. 7, when the retaining clip 42 is securing the cabinet top 28, the tab 50 engages a mounting hole 76 in the top back rail 33, while the sixth curved portion 64 extends through a first cabinet top aperture 78, and the second end portion 68 is secured through a cabinet top aperture 80.

Since the top back rail 33 is substantially coplanar with the top surfaces 32 of the cabinet panels, the vertical space required to mount the retaining clips 42 is significantly reduced.

Figure 8:
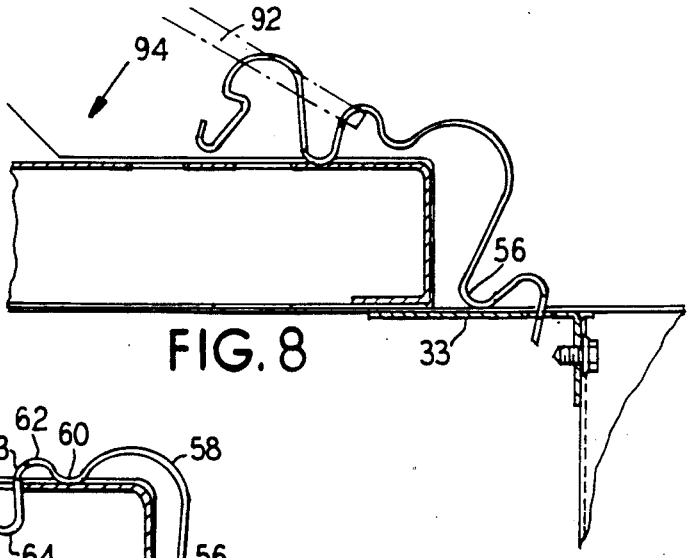
FIG. 8 is a sectional view of the retaining clip showing a suggested method of engagement with the washer cabinet top.
Figure 5:
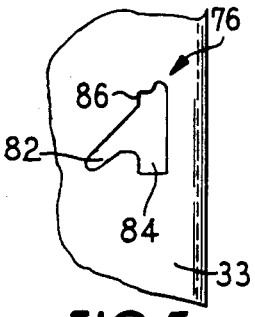
FIG. 5 is a plan view partially broken away, of a mounting hole in the top rear rail of the washer forming part of the present invention.
Figure 6:
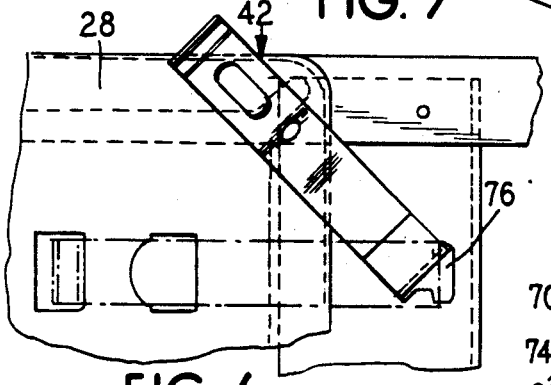
FIG. 6 is a plan view, partially broken away, showing the retaining clip in its pre-installation position in solid line, and in its installed position in phantom line.
Figure 4:
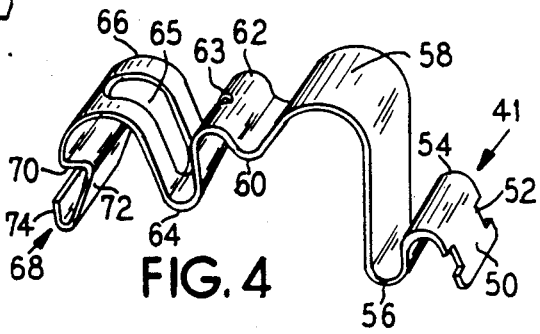
FIG. 4 is a perspective view of a retaining clip alone.

FIGS. 5–8 illustrate the pivotability of retaining clip 50. FIG. 5 shows the mounting hole 76 which includes an angled slot 82 and a securing portion 84 with stop edges 86. To install the retaining clips 42 into the top back rail 33, the tabs 50 must be inserted through the slots 82, and notches 52 are then pivoted into engagement with the securing portions 84, as shown in FIG. 6. Such installation prevents the retaining clips 42 from accidentally coming out of top back rail 33 during normal servicing of the appliance. When the retaining clips 42 are in the securing position shown in phantom line in FIG. 6, the tab 50 is located in the securing portion 84, and the retaining clip engages stop edges 86. Since the width of the tab 50 is greater than that of the securing portion 84, the retaining clip 42 is held in the securing position A suggested method of engaging the retaining clip 42 with the cabinet top 28 is shown in FIG. 8. Aligned apertures 63 and 65 in retaining clip 42 receive the end of a Phillips screwdriver 92 or other suitable straight tool. After insertion of the tool, a generally downward force is applied in the direction of arrow 94 forcing the clip downward by lever action until the horizontal portion 70 is forced through the aperture 80 and locks onto cabinet top 28.

A suggested method of disengaging the clip 42 is shown in FIG. 7. The blade 88 of a screwdriver or other suitable tool is inserted in the flanged end 74 of the clip 42, and force is applied in the direction of arrow 90 using the lower part of the seventh curved portion 66 adjacent to the sixth curved portion 64 as a fulcrum to disengage the horizontal portion 70 from the cabinet top 28. Once the horizontal portion 70 has been disengaged, the retaining clip 42 is pivoted upwardly to release the sixth curved portion 64 from the aperture 78 in the cabinet top 28. This upward pivoting releases spring tension so that the retaining clip 42 can be rotated rearwardly within notch 52 to the position of FIG. 8, which then allows the retaining clip to be pivoted horizontally to the service position of FIG. 6.

Figure 9:
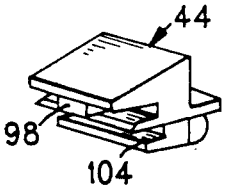
FIG. 9 is a perspective view of a top-lock useful in the present invention.

As shown in FIGS. 2, 7, and 9, a front 96 of cabinet top 28 is secured with top locks 44. Each top lock 44 includes a front tab 98 that engages a notch 100 in a bottom lip 102 of the front of cabinet top 28. A bottom groove 104 of the top lock receives the top surface 32 of the front panel 22. When the cabinet top 28 slides into its operating position, the notches 100 slide into engagement with the front tabs 98 of the top locks 44, which are already in place. FIG. 7 shows a top lock when the cabinet top is in the above-described position When the retaining clips 42 are in the securing position shown in FIGS. 3 and 7, they exert a downward bias force at the fourth curved portion 60 to retain the cabinet top 28 against the rest of the cabinet 30. The retaining clips 42 also bias the bottom lip 102 of the front of the cabinet top 28 against the top locks 44. Thus, the retaining clips provide a connection between the cabinet top 28 and the top back rail 33, and further provide a biasing force for connection of the cabinet top to the front panel 22.

Figure 10:
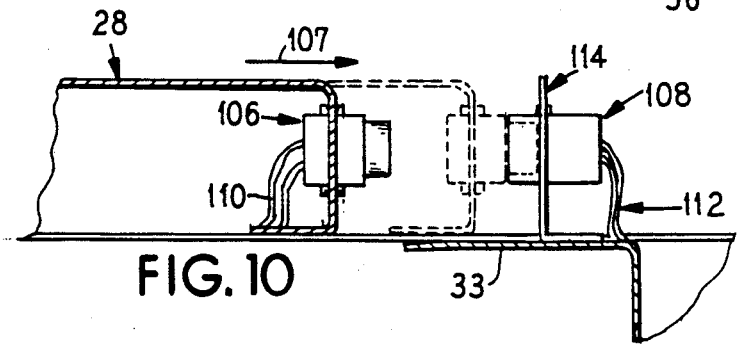
FIG. 10 is a broken-away sectional view of an electrical connector for a power-interrupting lid-open switch.

FIGS. 2 and 10 shows the operation of the electrical connector 46. The connector 46 includes disconnect plugs 106 and 108, which are attached to leads 110 and 112. The disconnect plug 106 is directly attached to the cabinet top 28, and the plug 108 is attached to the top back rail 33 via a mounting bracket 114. Leads 112 are connected to a power-supply (not shown), and leads 110 are connected to a power-interrupting lid-open switch (not shown) of conventional design. Horizontal sliding of the cabinet top 28 in the direction of the arrow 107 moves the connector 46 between a disconnected position and a connected position (shown in broken line). When in their securing position, the retainer clips 42 prevent the accidental disconnection of the electrical connector 46.

Figure 11:
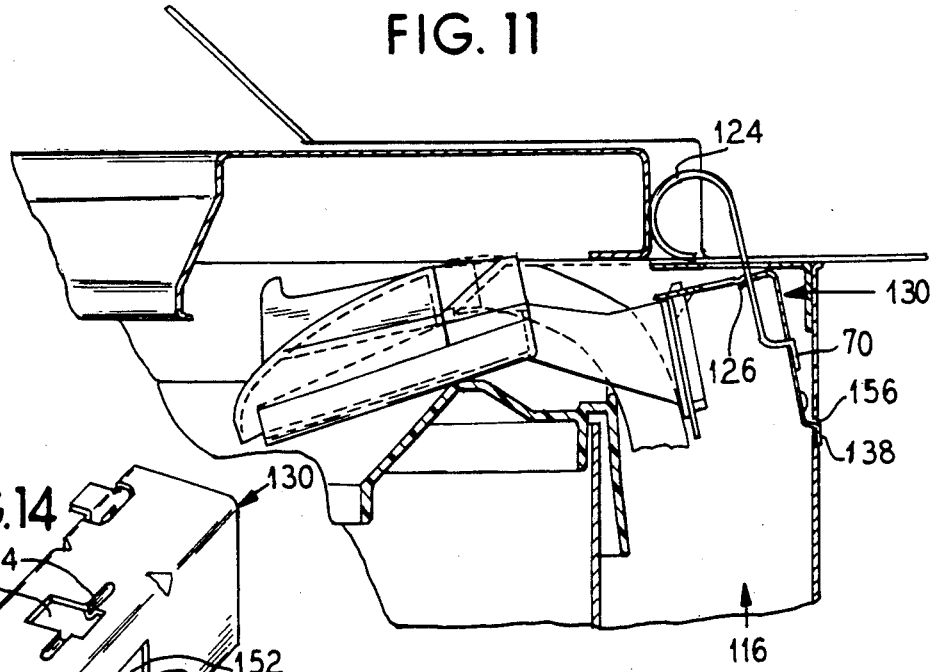
FIG. 11 is a broken-away sectional view showing a water-inlet vacuum-break in its service position.
Figure 12:
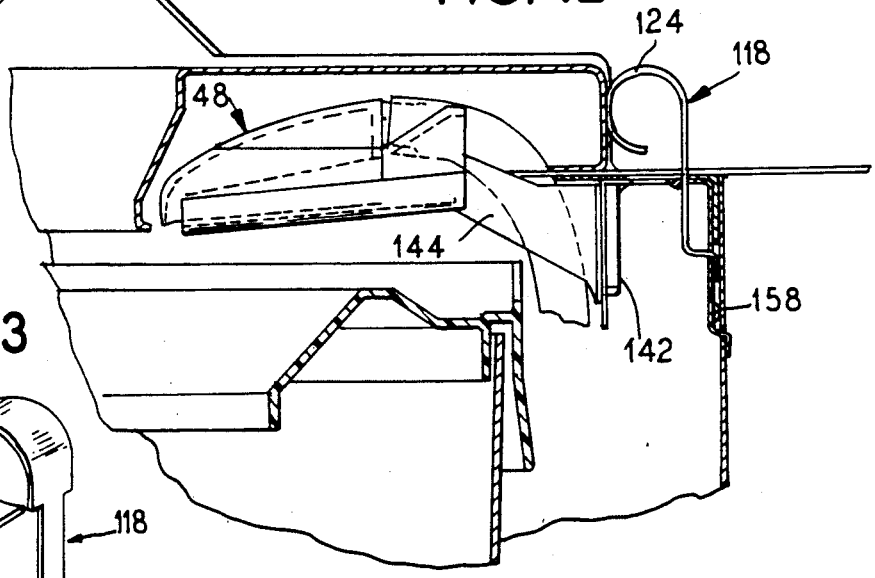
FIG. 12 is a broken-away sectional view showing a water-inlet vacuum-break in its operating position.
Figure 13:
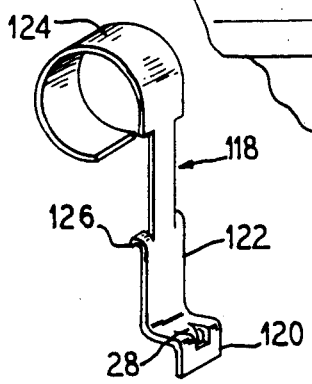
FIG. 13 is a perspective view of a spring lever useful in the present invention.

FIGS. 11 and 12 show the water-inlet vacuum-break 48, which is secured to the washer 20 via a mounting assembly 116 The mounting assembly 116 includes a spring lever 118 (FIG. 13) having a flange 120 leading to a straight portion 122, which in turn leads to a curved contact end 124. A pair of curved tabs 126 occur at approximately the midpoint of the straight portion 122, and a third curved tab 128 is opposite the flange 120.

Figure 14:
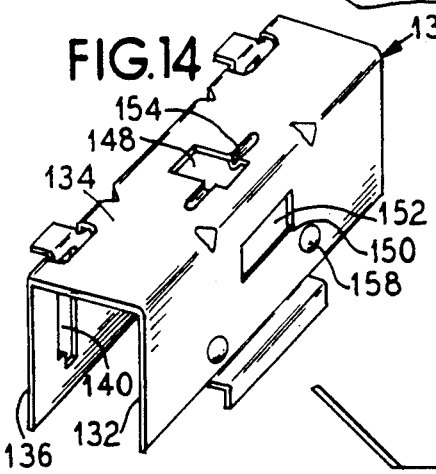
FIG. 14 is a perspective view of a mounting bracket useful in the present invention.

The mounting assembly 116 further includes a spring lever mounting bracket 130, shown in FIG. 14, which as a rear portion 132, a top portion 134, and a front portion 136. A bracket flange 138 extends from the rear portion 132 and the front portion 136 includes a pair of slots 140 adapted to receive mounting extensions 142 of a support 144 for the water-inlet vacuum-break 48.

The spring lever 118 is secured to the mounting bracket 130 in the following manner. The spring lever 118 is inserted through an aperture 148 in the top portion 134 of the mounting bracket. The spring lever 118 is then positioned so that the bottom edge 150 of an aperture 152 in the rear portion 132 of the mounting bracket 130 is held between the flange 120 and the curved tab 128 of the spring lever. The spring lever 118 is then pivoted rearwardly about the bottom edge 150 until the curved tabs 126 snap into place behind a pair of retaining protrusions 154 extending downwardly from the top portion 134 of the mounting bracket 30. The bracket flange 138 extends through an aperture 156 in the rear panel 26 to pivotably secure the mounting assembly 116 to the washer 20. Contact protrusions 158 on the rear portion 132 of the mounting bracket 130 provide a rearward pivot limit for the mounting assembly 116.

Operation of the mounting assembly 116 is as follows. During operation of the washer 20, the cabinet top 28 retains the water-inlet vacuum-break 48 in the position shown in FIG. 12. However, when the cabinet top 28 is moved forward to accommodate servicing, the retaining force exerted by the top 28 is removed Gravity then acts to pivot the mounting assembly 116 (and the attached water-inlet vacuum-break 48) downwardly about the bracket flange 138 to a position below that of a rear bottom flange 158 of the cabinet top 28. This permits the bottom flange 158 to clear the vacuum-break 48 when the cabinet top 28 is removed. Consequently, service access to the interior of the washer 20 can be gained by horizontally sliding the cabinet top 28 for its removal. When the cabinet top 28 is reinstalled its rear surface 160 pushes the curved contact end 124, which pivots the mounting assembly 116 upwardly and rearwardly in the direction of the arrow 162 and, in its final position, returns the vacuum-break 48 to its operating position shown in FIG. 12.

The following is a description of the procedure employed in securing a cabinet top to the rest of the cabinet applying the principles of the present invention. With the retaining clips 42 in their service position (FIG. 8) the cabinet top 28 is placed atop the cabinet 30 with the sides of the cabinet top aligned with the side panels 24. The cabinet top 28 is then slid horizontally towards the rear panel 26 of the cabinet in the direction of the arrow 107 in FIG. 10 until the notches 100 engage the top locks 44. The sliding of the cabinet top causes the cabinet top rear surface 160 to engage the curved contact end 124 of the spring lever 118 to bring the water-inlet vacuum-break 48 into its operating position, while simultaneously actuating the electrical connector 46 by causing the engagement of the disconnect plugs 106 and 108. The spring clips 42 are then engaged with the cabinet top 28, preferably using the method described hereinabove with reference to FIG. 8. To remove the cabinet top, the clips are disengaged, preferably as described with reference to FIG. 7, and the above procedures are reversed.

As can be seen from the foregoing description the present invention provides a cabinet top that can be removed from a front-serviceable appliance by horizontal sliding, thus significantly reducing the vertical space required for servicing. Additionally, this invention provides for automatic actuation of an electrical connector for a power-interrupting lid-open switch.

Although this invention has been described in connection with this particular embodiment, it will be apparent to those skilled in the art that various changes may be made therein without departing from the scope and spirit of the invention as set forth in the appended claims.

We claim:

1. A front-serviceable appliance of the type including a cabinet having a cabinet top and requiring the removal of said cabinet top from the rest of said cabinet for servicing, said appliance including in combination:

resilient retaining means for securing said cabinet top to the rest of said cabinet and simultaneously preventing accidental disconnection of an electrical connector disposed on said cabinet and actuated by movement of said cabinet top;

vacuum-break mounting means, disposed on said cabinet and actuable by said cabinet top, for permitting movement of a water inlet vacuum break from an operating position to a service position; and wherein said cabinet top is horizontally slidable into a position actuating said vacuum-break mounting means and permitting the securing of said cabinet top by said retaining means.

2. A front-serviceable appliance according to claim 1, further wherein said appliance further comprises:

said cabinet further including a front panel, two side panels, a rear panel, and a top back rail adjacent said rear panel, with said front, side, and rear panels having substantially coplanar top surfaces;

wherein said resilient retaining means comprises at least one retaining clip maintaining said cabinet and said cabinet top in assembled relationship, said at least one retaining clip having first end and a second end;

wherein the first end of said at least one retaining clip is engageable with at least one aperture in said cabinet top; and wherein said top back rail is substantially coplanar with the top surfaces of said front, side, and rear panels.

3. A front-serviceable appliance according to claim 1 further wherein:

each of said at least one retaining clips comprises a series of coterminously connected curved portions alternately connected in an opposed manner to form a generally cosinusoidal curve.

4. A front-serviceable appliance according to claim 3 further wherein:

said at least one retaining clip comprises two aligned apertures, wherein each said aperture is in a separate one of said curved portions, said apertures aligned to receive a lever for applying force to install said retaining clip.

5. A front-serviceable appliance according to claim 4 further wherein:

said series of coterminously connected curved portions comprises a series of at least seven curved portions.

6. A front-serviceable appliance according to claim 2 further wherein:

said at least one retaining clip comprises a body section between said first and second ends; and said first end comprises a tab separated from said body section by a pair of opposed notches.

7. A front-serviceable appliance according to claim 6, further wherein:

each mounting hole in said top back rail comprises a securing portion having at least one stop edge and a slot angled from said securing portion;

wherein said angled slot receives said first end of said at least one retaining clip to permit said cabinet top to slide, and said securing portion receives the first end of said at least one retaining clip to permit the cabinet top to be secured.

8. A front-serviceable appliance according to claim 1, and further wherein, in its operating position, said vacuum-break extends above a bottom surface of said cabinet top, and in its service position said vacuum-break extends completely below the bottom surface of said cabinet top.

9. A front-serviceable appliance according to claim 8, further wherein:

said means for moving the water-inlet vacuum break comprises a spring lever bracket having a curved contact end for engaging said cabinet top, and a second flanged end attached to said rear panel of said appliance.

10. A front-serviceable appliance according to claim 9, further wherein:

said water-inlet vacuum-break is attached to a mounting bracket secured to said spring lever bracket 11. A front-serviceable appliance according to claim 1, further wherein said electrical connector comprises means for connecting a power-interrupting lid-open switch to a power supply.

12. A front-serviceable appliance according to claim 11, further wherein:

said electrical connector comprises first and second mutually engageable disconnect plugs;

said first disconnect plug is secured to a rear surface of the cabinet top;

said second disconnect plug is secured to a mounting bracket attached to a top back rail of said appliance; and wherein the actuation of said electrical connector comprises the engagement or disengagement of said disconnect plugs.

13. A front-serviceable appliance of the type having a cabinet including a front, two side panels, a rear panel, and a top back rail adjacent said rear panel, with said front, side, and rear panels having substantially coplanar top surfaces;

at least one retaining clip maintaining said cabinet and said cabinet top in assembled relationship, said at least one retaining clip having first end and a second end;

wherein the first end of said at least one retaining clip is engageable with a mounting hole in said top back rail, and the second end of said at least one retaining clip is engageable with at least one aperture in said cabinet top; and wherein said top back rail is substantially coplanar with the top surfaces of said front, side and rear panels.

14. A front-serviceable appliance according to claim 13, further wherein:

said at least one retaining clips comprises a series of coterminously connected curved portions alternately connected in an opposed manner to form a generally cosinusoidal curve.

15. A front-serviceable appliance according to claim 14, further wherein:

said at least one retaining clip comprises two aligned apertures, wherein each of said apertures is in a separate one of said curved portions, said apertures aligned to receive a lever for applying force to install said retaining clip.

16. A front-serviceable appliance according to claim 15, further wherein:

said series of coterminously connected curved portions comprises a series of at least seven curved portions.

17. A front-serviceable appliance according to claim 13, further wherein:

said at least one retaining clip comprises a body section between said first and second ends; and said first end comprises a tab separated from said body section by a pair of opposed notches.

18. A front-serviceable appliance according to claim 17, further wherein:

each mounting hole in said top back rail comprises securing portion having at least one stop edge, and a slot angled from said securing portion;

wherein said angled slot receives said first end of said at least one retaining clip to permit said cabinet top to slide, and said securing portion receives the first end of said at least one retaining clip to permit the cabinet top to be secured.

19. A front-serviceable appliance of the type requiring removal of a cabinet top for servicing, said appliance comprising the following:

a water-inlet vacuum-break;

means for moving said vacuum-break between an operating position extending above the bottom of said cabinet top and a service position completely below the bottom of said cabinet top; and wherein said vacuum-break moving means is actuated in response to horizontal sliding of said cabinet top.

20. A front-serviceable appliance according to claim 19, further wherein said means for moving the water-inlet vacuum-break comprises a spring lever bracket having a curved contact end for engaging said cabinet top, and a second flanged end attached to said rear panel of said appliance.

21. A front-serviceable appliance according to claim 20, further wherein:

said water-inlet vacuum-break is attached to a mounting bracket secured to said spring lever bracket.

22. A front-serviceable appliance of the type including a cabinet having a cabinet top and requiring removal of said cabinet top from the rest of said cabinet for servicing, said appliance comprising the following:

means disposed on said cabinet for allowing said cabinet top to slide horizontally relative to the rest of said cabinet; and selectively-actuable electrical connection means, disposed on said cabinet, for establishing an electrical connection between said appliance and a source of electrical power in response to horizontal sliding of said cabinet top.

23. A front-serviceable appliance according to claim 22, further wherein:

said electrical connection means comprises first and second mutually engageable disconnect plugs;

said first disconnect plug is secured to a rear surface of the cabinet top;

said second disconnect plug is secured to a mounting bracket attached to a top back rail of said appliance; and wherein the actuation of said electrical connection comprises the engagement or disengagement of said disconnect plugs.

* * * * *